US010030213B2

(12) United States Patent
Holderbaum et al.

(10) Patent No.: US 10,030,213 B2
(45) Date of Patent: Jul. 24, 2018

(54) LIQUID CATIONIC FORMULATION AND METHOD FOR THE PRODUCTION THEREOF

(71) Applicant: Henkel AG & Co. KGaA, Duesseldorf (DE)

(72) Inventors: Thomas Holderbaum, Hilden (DE); Roland Schaefer, Duesseldorf (DE); Rainer Diedrich, Hilden (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/247,320

(22) Filed: Aug. 25, 2016

(65) Prior Publication Data

US 2016/0362635 A1 Dec. 15, 2016

Related U.S. Application Data

(63) Continuation of application No. PCT/EP2015/056274, filed on Mar. 24, 2015.

(30) Foreign Application Priority Data

Mar. 26, 2014 (DE) ..... 10 2014 205 661

(51) Int. Cl.

| | |
|---|---|
| ***C11D 3/20*** | (2006.01) |
| ***C11D 11/00*** | (2006.01) |
| ***C11D 3/00*** | (2006.01) |
| ***C11D 3/37*** | (2006.01) |
| ***C11D 17/00*** | (2006.01) |

(52) U.S. Cl.

CPC ..... *C11D 3/0015* (2013.01); *C11D 3/201* (2013.01); *C11D 3/2068* (2013.01); *C11D 3/2093* (2013.01); *C11D 3/2096* (2013.01); *C11D 3/3765* (2013.01); *C11D 3/3773* (2013.01); *C11D 11/0017* (2013.01); *C11D 17/003* (2013.01); *C11D 17/0004* (2013.01); *C11D 17/0013* (2013.01)

(58) Field of Classification Search

CPC ..... C11D 3/20; C11D 3/2006; C11D 3/2041; C11D 3/3746; C11D 3/3769; C11D 11/00

See application file for complete search history.

(56) References Cited

U.S. PATENT DOCUMENTS

2011/0245140 A1 10/2011 Demeyere

FOREIGN PATENT DOCUMENTS

| | | | | | |
|---|---|---|---|---|---|
| EP | 2399978 | A1 | | 12/2011 | |
| WO | 99/06455 | A1 | | 2/1999 | |
| WO | 03/102043 | A1 | | 12/2003 | |
| WO | 2004/050812 | A1 | | 6/2004 | |
| WO | 2005/073358 | A1 | | 8/2005 | |
| WO | WO 2005/073358 | | * | 8/2005 | ..... C11D 1/62 |
| WO | 2013/016029 | A1 | | 1/2013 | |

OTHER PUBLICATIONS

PCT International Search Report (PCT/EP2015/056274) dated Jan. 6, 2015.

* cited by examiner

*Primary Examiner* — Brian P Mruk
(74) *Attorney, Agent, or Firm* — Thomas G. Krivulka

(57) ABSTRACT

The invention relates to a thickening concentrate for continuously producing a liquid cationic formulation of domestic cleaners or fabric softeners and to a method for continuously producing a liquid cationic formulation of domestic cleaners or fabric softeners, in which method a thickening concentrate according to the invention is used. The invention further relates to a formulation that can be obtained in accordance with the method according to the invention.

11 Claims, No Drawings

LIQUID CATIONIC FORMULATION AND METHOD FOR THE PRODUCTION THEREOF

FIELD OF THE INVENTION

The present invention generally relates to a thickening concentrate for continuously producing a liquid cationic formulation of household cleaners or fabric softeners, and to a method for continuously producing a liquid cationic formulation of household cleaners or fabric softeners, in which a thickening concentrate a method according to the invention is used. The present invention also relates to a formulation that can be obtained by the method according to the invention.

BACKGROUND OF THE INVENTION

Liquid cationic formulations of household cleaners or fabric softeners are frequently aqueous or alcoholic formulations. To appropriately adapt the rheological properties of the respective formulation to the required use and the customer's request, it is customary to add additives influencing the viscosity to the formulation, These can be polymers, for example. WO 99/06455 A, for example, describes thickening agents for acid compositions that comprise cationic homopolymers having a content of cross-linking agents of 50 to 600 ppm. Suitable polymers are also described in WO 2004/050812 A1, for example.

However, it has been shown in the production of liquid formulations that it is not possible or difficult to continuously meter a corresponding polymer into the liquid cationic formulation, in particular when these are present in solid form. For this reason, liquid formulations are usually produced in a batch mixer. With batch production, however, a consistent quality across different batches can only be ensured with high complexity, so that a consistent quality of the liquid cationic formulation is possible only within certain limits. Differing concentrations of polymers, and thus quality differences, can also occur within a batch.

Cationic acrylic polymers have emerged as particularly suitable thickening agents. These are usually present as solids, for example in the form of a powder. Since the continuous metering of a powder is almost impossible to implement, solids are usually first dissolved in a suitable solvent, or suspended in a suspending agent, and then added as a solution, or as a suspension, to a liquid formulation. Liquids used as solvents or suspending agents are preferably those that are also present in the actual formulation, so as to achieve good miscibility. WO 2013/016029 A1, for example, discloses a method for producing a composition that comprises an agent for setting rheological properties. In this method, a rheology additive is dispersed in an anhydrous but water-miscible liquid carrier material, such as a surfactant, a humectant, a polymer, an oil, or mixtures thereof. Water-swellable polymers, non-water soluble crystalline polymers or the mixtures thereof are used as the rheology additive.

When suitable cationic acrylic polymers are now added to a solvent, which represents the main component of the liquid cationic formulation, these swell. This yields a viscous, rubber-like mass, which can no longer be added to the liquid cationic formulation in a continuous production method. A need therefore exists for an option to continuously produce a liquid cationic formulation, so as to enable a cost-effective production method that also enables a continuous consistent quality of the resultant product.

Furthermore, other desirable features and characteristics of the present invention will become apparent from the subsequent detailed description of the invention and the appended claims, taken in conjunction with this background of the invention.

BRIEF SUMMARY OF THE INVENTION

A thickening concentrate for continuously producing a liquid cationic formulation of household cleaners or fabric softeners, wherein the concentrate comprises: a cationic acrylic polymer as a thickening agent and at least one suspending agent for the acrylic polymer of the following formula (A)

(A)

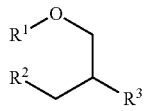

where $R^1$ denotes a hydrogen atom, or together with $R^2$ for ring closure denotes a carbonyl group; $R^2$ denotes a hydrogen atom, a methyl group, a 3-hydroxypropoxy group, or together with $R^1$ for ring closure denotes a carbonyl group; and $R^3$ denotes a hydrogen atom, a 1-hydroxyprop-2-yloxy group or a 2-hydroxypropoxy group.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The object of the present invention is achieved by a thickening concentrate for continuously producing a liquid cationic formulation of household cleaners or fabric softeners, which comprises a cationic acrylic polymer as a thickening agent and a suspending agent having a propyleneoxy structure for the acrylic polymer. A first subject matter of the invention is thus a thickening concentrate for continuously producing a liquid cationic formulation of household cleaners or fabric softeners, which comprises a cationic acrylic polymer as a thickening agent and at least one suspending agent for the acrylic polymer of the following general formula (A)

(A)

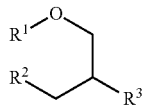

where $R^1$ denotes a hydrogen atom, or together with $R^2$ for ring closure denotes a carbonyl group; and $R^2$ denotes a hydrogen atom, a methyl group, a 2-hydroxypropoxy group, a 3-hydroxypropoxy group, or together with $R^1$ for ring closure denotes a carbonyl group;

$R^3$ denotes a hydrogen atom, a 1-hydroxyprop-2-yloxy group or a 2-hydroxypropoxy group.

Within the scope of a special embodiment, the thickening concentrate includes at least one compound of formula (A-1) as the suspending agent for the acrylic polymer,

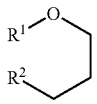

(A-1)

where $R^1$ denotes a hydrogen atom, or together with $R^2$ for ring closure denotes a carbonyl group; and $R^2$ denotes a hydrogen atom, a methyl group, a 3-hydroxypropoxy group, or together with $R^1$ for ring closure denotes a carbonyl group.

The suspending agent is preferably selected from the group consisting of dipropylene glycol (preferably with the GAS No. 25265-71-8), 1-butanol, 1-propanol, and γ-butyrolactone, and the mixtures thereof. A thickening concentrate according to the invention is present in the form of a suspension, which can be used in a continuous production method of liquid cationic formulations of fabric softeners or household cleaners.

The thickening concentrate according to the invention can include a suspending agent. It is also possible according to the invention for a mixture of two or more different suspending agents to be present in the thickening concentrate. Surprisingly, it has been shown that the suspending agents according to the invention and the mixtures thereof are suitable for suspending cationic acrylic polymers such that the suspension does not thicken significantly, so that a continuous metered addition for producing the liquid cationic formulation of household cleaners or fabric softeners is possible. The suspension made of the suspending agent according to the invention and the cationic acrylic polymer is not necessarily sedimentation-stable. However, the acrylic polymer is easy to resuspend in the aforementioned suspending agents. The suspending agents according to the invention have a high flash point and are not toxic. A low flash point and toxicity would mean that these are precluded from the production of liquid cationic formulations of household cleaners or fabric softeners since these would be precluded from use in households.

It is furthermore relevant from an economic view that the suspending agent can be obtained cost-effectively. The suspending agent can be used in a technically pure grade. Surprisingly, it has been shown that a thickening concentrate is stable with respect to small amounts of water. According to the invention, the concentrate can thus include water in an amount of 5 wt. % or less, and in particular of 3 wt. % or less, based on the total weight of the concentrate.

According to the invention, the concentrate comprises the suspending agent in an amount of 70 wt. % to 99 wt. %, and in particular in an amount of 75 wt. % to 90 wt. %, based on the total weight of the concentrate. The concentrate preferably includes 1 to 30 wt. %, and in particular 10 to 25 wt. %, of cationic acrylic polymer, based on the total weight of the concentrate. In these ranges, a thickening concentrate is obtained which can be metered to liquid cationic formulations of household cleaners or fabric softeners using continuous production methods known in the related art.

The suspending agent is compatible with the components of the liquid cationic formulation. It can preferably be mixed at any ratio in particular with the solvent of the formulation. Reactions with the components of the formulation do not take place. The metered addition of the concentrate is therefore possible in any arbitrary amount, so that the viscosity of the cationic formulation can be set as needed. If the concentrate comprises more than 30 wt. % of cationic acrylic polymer, the concentrate itself already has a high viscosity. Flowability is thus impaired. A metered addition, for example by way of a pump, is then possible only with difficulty. In this case, a continuous production is then also no longer possible, since a continuous metered addition is no longer possible due to the high viscosity of the thickening concentrate. If the concentrate comprises less than 1 wt. % of cationic acrylic polymer, an economical production of the cationic formulation of household cleaners or fabric softeners is no longer possible.

The end product should preferably include the thickening concentrate in a proportion of 1 wt. % or more, based on the total weight of the formulation. If the content of cationic acrylic polymer in the concentrate is less than 1 wt. %, the content of thickening agent in the end product is very low, so that a change in the viscosity cannot be established, or roughly cannot be established. The concentrate thus preferably includes the acrylic polymer in a proportion of 10 wt. %. This allows an economical metered addition of the concentrate, while providing a high variability of setting the viscosity of the liquid cationic formulation of household cleaners or fabric softeners.

In a preferred embodiment, the weight ratio of the suspending agent to the acrylic polymer ranges from 4:1 to 1:3. It has been shown that, in this weight ratio, the thickening concentrate can be used well in continuous production methods known in the related art. In customary continuous production methods, the thickening concentrate is pumped with the aid of a pump to a liquid cationic formulation of household cleaners or fabric softeners that do not yet include any thickening agent in the formulation thereof. So as to achieve even metering, the thickening concentrate should preferably be pumpable. So as to ensure this, the viscosity of the concentrate is preferably 10000 mPas or less, and in particular 7500 mPas or less. In this viscosity range, it is ensured that the concentrate can be pumped to a liquid cationic formulation of household cleaners or fabric softeners in a continuous production method using a commercially available pump.

The cationic acrylic polymer is preferably present in the form of solid particles. The particles are preferably spherical particles, which in particular have a ball shape. The mean particle size (volume mean diameter) of the solid particles is in particular in the range of 100 to 900 μm, preferably in the range of 200 to 800 μm, and particularly preferably in the range of 250 to 750 μm. If the solid particles are present in a ball shape, the diameter of the ball corresponds to the particle size. In all other spherical shapes, the particle size corresponds to the size of the particles having the largest spatial extension. The particle size can be determined by way of scanning electron microscopy (SEM) images.

The cationic acrylic polymer is hygroscopic. In the case of too small a particle size of 100 μm or less, in particular of 200 μm or less, and particularly of 250 μm or less, it is possible for so much water to collect on the surface of the particles that it is no longer possible to obtain a stable suspension. Rather, swelling of the cationic acrylic polymer takes place, so that no meterable suspension, but a highly viscous, rubber-like mass is obtained after the mixing with the suspending agent according to the invention. In contrast, if the particle size is more than 900 μm, these large, and therefore also heavy, particles can settle more quickly than particles having a size of 900 μm or less, in particular of 800 μm or less, and particularly of 750 μm or less.

Suitable cationic acrylic polymers that can be used as thickening agents according to the invention are described in WO 03/102043 A1 on pages 1 to 4, for example, the entire content of which is hereby included by reference. The cationic acrylic polymers according to the invention are therefore preferably formed of a) a water-soluble, ethylenically unsaturated monomer, or a mixture of these monomers comprising at least one cationic monomer;

b) at least one cross-linking agent in an amount of more than 50 ppm, based on the weight of compound a); and c) at least one chain transfer agent.

The cationic monomer preferably corresponds to a compound according to the following compound (I)

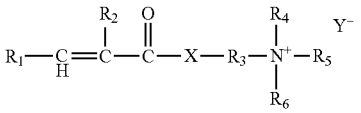

(I)

in which independently of one another $R_1$ represents hydrogen or methyl, $R_2$ represents hydrogen or $C_1$ to $C_4$ alkyl, $R_3$ represents $C_1$-$C_4$ alkylene, $R_4$, $R_5$ and $R_6$ each independently of one another represent hydrogen or $C_1$ to $C_4$ alkyl, X represents —O— or —NH—, and Y represents Cl, Br, I, bisulfate or methosulfate.

The respective alkyl groups can be linear or branched.

The cross-linking agent b) preferably comprises at least two ethylenically unsaturated units. Suitable preferred cross-linking agents are divinylbenzene, tetraallyl ammonium chloride, allyl acrylates and allyl methacrylates, diacrylates and dimethacrylates of glycols and polyglycols, butadiene, 1,7-octadiene, allyl acrylamides and allyl methacrylamides, bisacrylamido acetic acid, N,N'-methylene bisacrylamide and polyol polyallyl ether, such as polyallyl sucrose and pentaerythritol triallyl ether. Particularly preferred cross-linking agents are tetraallyl ammonium chloride, allyl acrylamides and allyl methacrylamides, bisacrylamido acetic acid and N,N'-methylene bisacrylamide. Tetraallyl ammonium chloride and N,N'-methylene bisacrylamide are especially particularly preferred cross-linking agents. It is also possible to use mixtures of the cross-linking agents.

In a preferred embodiment, the cationic acrylic polymer comprises at least one cross-linking agent b) in a proportion of 50 to 1200 ppm, preferably of 500 to 1000 ppm, and particularly preferably of 700 to 900 ppm, in each case based on the weight of component a).

The chain transfer agent c) is preferably selected from the group consisting of the mercaptanes, malic acid, lactic acid, formic acid, isopropanol, and hypophosphites. The content of chain transfer agents c) is preferably from 10 to 50,000 ppm, and preferably from 100 to 10,000 ppm, in each case based on the weight of component a).

In a particularly preferred embodiment, the cationic acrylic polymer is formed as a cationic monomer of formula (Ia) shown hereafter:

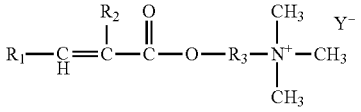

(Ia)

in which independently of one another

R1 represents hydrogen or methyl,

R2 represents hydrogen or methyl,

R3 represents $C_1$-$C_2$ alkylene, and

Y represents Cl, Br or I and i) the at least one cross-linking agent is selected from the group consisting of divinylbenzene, tetraallyl ammonium chloride, allyl acrylates and allyl methacrylates, diacrylates and dimethacrylates of glycols and polyglycols, butadiene, 1,7-octadiene, allyl acrylamides and allyl methacrylamides, bisacrylamido acetic acid, N,N'-methylene bisacrylamide and polyol polyallyl ether, and is present in an amount of 50 to 1,200 ppm, preferably in an amount of 50 to 1,000 ppm, and in particular preferably in an amount of 700 to 900 ppm, in each case based on the weight of component a), and ii) at least one chain transfer agent, which is selected from the group consisting of malic acid, lactic acid, formic acid, isopropanol and hypophospites, is present in an amount of 1,000 to 9,000 ppm, and preferably in an amount of 2,000 to 5,000 ppm, in each case based on the weight of component a).

In a further embodiment, the present invention relates to a method for continuously producing a liquid cationic formulation of household cleaners or fabric softeners. The method is characterized in that a concentrate according to the invention comprising a liquid, hydrous premix is added. This premix is a solution that comprises the active components of the formulation. Thickening agents are not present in the premix. The premix is thus the formulation, except without thickening agents. In a first embodiment, the concentrate according to the invention is metered into a flow of the premix. Mixing between the premix and the concentrate according to the invention takes place based on the flow properties of the premix and of the concentrate. In an alternative embodiment, the liquid, aqueous premix and the concentrate according to the invention are mixed with each other in the flow by way of a circulating pump or a static mixer, preferably by way of a static mixer.

Contrary to the production in batches known in the related art, the method according to the invention relates to a continuous production method in which a thickening concentrate in the form of a premix is added to the formulation. This allows a continuous production process in a consistent quality. At the same time, the amount of concentrate that is added to the formulation can be modified at any time, so that it is possible to respond quickly and easily to changing customer requests or other changes in the formulation.

The pH value of the formulation is preferably 6 or less, and in particular 4 or less. The formulation is preferably an acid cationic formulation. If the formulation according to the invention is a household cleaner, the pH value is preferably in the range from 2 to 5, and in particular from 3 to 4. If the formulation according to the invention is a fabric softener, the pH value is preferably in the range from 1 to 6, and particularly preferably from 1.5 to 3.5.

In a further embodiment, the object of the present invention is achieved by a liquid cationic formulation of household cleaners or fabric softeners which can be obtained by the method according to the invention. When the end product is mentioned in the present application, this shall be understood to mean the liquid, cationic formulation of household cleaners or fabric softeners according to the invention. The formulation according to the invention preferably comprises the thickening concentrate in a proportion of 1 wt. % or more, based on the total weight of the formulation. If the proportion of concentrate in the formulation is low, an influence on the viscosity is almost undetectable. The use of the thickening concentrate would thus not be economical here.

A "formulation of household cleaners or fabric softeners" shall be understood to mean cleaning agents found in households, such as bathroom cleaners, toilet cleaners, cleaners for hard surfaces, as well as fabric softeners for laundry.

In addition to the thickening concentrate according to the invention, the liquid cationic formulation according to the invention furthermore comprises customary components known in the related art. The suspending agent according to the invention for the acrylic polymer is thus soluble in water or the alcoholic solution.

The formulation is preferably a fabric softener for laundry. This comprises the thickening concentrate according to the invention in a proportion of 1 wt. % or more. Moreover, this comprises customary components for fabric softeners for laundry, such as one or more textile-softening compounds, odorant compositions and further additives, such as alcohols, amphoteric or non-ionic surfactants, pH buffer substances, enzymes, fungicides or antioxidants.

In addition to the thickening concentrate according to the invention, a fabric softener for laundry usually comprises a textile-softening compound. It is preferable for the textile softening compound to be selected from the group of the quaternary ammonium compounds, polysiloxanes, textile softening clays, and mixtures thereof. These compounds are effective and commercially easily available textile softening compounds.

Furthermore, it is particularly advantageous for the fabric softener to include a quaternary ammonium compound as the textile-softening compound. It is in particular preferred for the quaternary ammonium compound to be a compound of the following general formula (B):

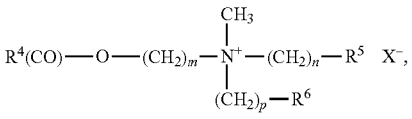

(B)

where $R^4$ denotes an aliphatic alk(en)yl group having 11 o 21 carbon atoms comprising 0, 1, 2 or 3 double bonds and/or optionally comprising substituents;

$R^5$ denotes H, OH or $O(CO)R^7$;

$R^6$ independently of $R^5$ denotes H, OH or $O(CO)R^6$, wherein $R^7$ and $R^8$ independently of one another each denote an aliphatic alk(en)yl group having 11 to 21 carbon atoms comprising 0, 1, 2 or 3 double bonds;

m, n and p independently of one another can each have the value 1, 2 or 3; and $X^-$ can be either a halide, methosulfate, methophosphate or phosphate ion, and mixtures of these anions.

In fabric softeners that include quaternary ammonium compounds and in particular monoesters, diesters and/or triesters of fatty acids with alkanol amines as the textile-softening compounds, a particularly strong increase in the viscosity is achieved by a $C_{16}$ fatty material, which is present in a preferred embodiment in the end product according to the invention.

EXAMPLES a) 80 g dipropylene glycol (CAS No. 25265-71-8) and 20 g of a commercially available acrylate polymer in the form of solid spheres (Rheovis® CSP) from BASF were weighed out in a beaker glass and stirred by way of a laboratory mixer (propeller). While the acrylate polymer settles, it was easily stirred up again.

b) 3 g of water was metered to the mixture produced in a). Thickening or another change in the dispersion did not take place, which means that the system was not sensitive to fluctuations in the raw material.

The thickening concentrates from 1a) and 1b) were pumpable, and it was possible to use them in a continuous method for producing liquid formulations by way of commercially available metering pumps.

2. Example not according to the invention

As described under 1a), 20 wt. % diethylene glycol was used instead of dipropylene glycol. After the acrylate polymer was added, the mixture turned highly viscous (rubber-like), and in this form was not suitable for thickening aqueous solutions.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A thickening concentrate for continuously producing a liquid cationic formulation of household cleaners or fabric softeners, wherein the concentrate comprises:

a cationic acrylic polymer as a thickening agent and at least one suspending agent for the acrylic polymer of the following formula (A)

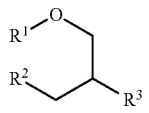

(A)

where $R^1$ denotes a hydrogen atom, or together with $R^2$ for ring closure denotes a carbonyl group; and $R^2$ denotes a hydrogen atom, a methyl group, a 3-hydroxypropoxy group, or together with $R^1$ for ring closure denotes a carbonyl group;

$R^3$ denotes a hydrogen atom, a 1-hydroxyprop-2-yloxy group or a 2-hydroxypropoxy group, and wherein the concentrate comprises the suspending agent in an amount of 70 wt. % to 99 wt. %, based on the total weight of the concentrate.

2. The thickening concentrate according to claim 1 characterized in that the suspending agent for the acrylic polymer is selected from the group consisting of dipropylene glycol, 1-butanol, 1-propanol, and γ-butyrolactone, and the mixtures thereof.

3. The thickening concentrate according to claim 1 characterized in that the suspending agent present is at least one suspending agent for the acrylic polymer of the formula general formula (A-1)

(A-1)

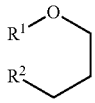

where $R^1$ denotes a hydrogen atom, or together with $R^2$ for ring closure denotes a carbonyl group; and $R^2$ denotes a hydrogen atom, a methyl group, a 3-hydroxypropoxy group, or together with $R^1$ for ring closure denotes a carbonyl group.

4. A thickening concentrate for continuously producing a liquid cationic formulation of household cleaners or fabric softeners, wherein the concentrate comprises:

a cationic acrylic polymer as a thickening agent and at least one suspending agent for the acrylic polymer of the following formula (A)

(A)

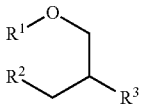

where $R^1$ denotes a hydrogen atom, or together with $R^2$ for ring closure denotes a carbonyl group; and $R^2$ denotes a hydrogen atom, a methyl group, a 3-hydroxypropoxy group, or together with $R^1$ for ring closure denotes a carbonyl group;

$R^3$ denotes a hydrogen atom, a 1-hydroxyprop-2-yloxy group or a 2-hydroxypropoxy group, and wherein the concentrate comprises water in an amount of 5 wt. % or less, based on the total weight of the concentrate.

5. The concentrate according to claim 4, characterized in that the weight ratio of the suspending agent to the acrylic polymer is in the range of 4:1 to 1:3.

6. The concentrate according to claim 1, characterized in that the cationic acrylate polymer is present in the form of particles, having a spherical particle size in the range of 0.2 μm to 1.5 μm.

7. The concentrate according to claim 1, characterized in that the viscosity is 10,000 mPas or less.

8. The concentrate according to claim 1, characterized in that at least one cationic acrylic polymer is present, which is formed of a) a water-soluble, ethylenically unsaturated monomer, or a mixture of these monomers comprising at least one cationic monomer;

b) at least one cross-linking agent in an amount of more than 50 ppm, based on the weight of compound a); and c) at least one chain transfer agent.

9. The concentrate according to claim 8, characterized in that the cationic monomer corresponds to a compound according to the following compound (I)

(I)

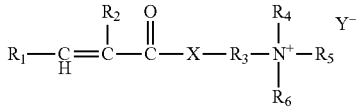

in which independently of one another $R_1$ represents hydrogen or methyl, $R_2$ represents hydrogen or $C_1$ to $C_4$ alkyl, $R_3$ represents $C_1$-$C_4$ alkylene, $R_4$, $R_5$ and $R_6$ each independently of one another represent hydrogen or $C_1$ to $C_4$ alkyl, X represents —O—or —NH—, and Y represents Cl, Br, I, bisulfate or methosulfate.

10. A method for continuously producing a liquid cationic formulation of household cleaners or fabric softeners, characterized in that a concentrate according to claim 1 is added to the formulation.

11. The method according to claim 10, characterized in that the pH value of the formulation is 6 or less.

* * * * *